US005264051A

United States Patent [19]

Huang

[11] Patent Number: 5,264,051

[45] Date of Patent: Nov. 23, 1993

[54] CAST GAMMA TITANIUM ALUMINUM ALLOYS MODIFIED BY CHROMIUM, NIOBIUM, AND SILICON, AND METHOD OF PREPARATION

[75] Inventor: Shyh-Chin Huang, Latham, N.Y.

[73] Assignee: General Electric Company, Schenectady, N.Y.

[21] Appl. No.: 801,556

[22] Filed: Dec. 2, 1991

[51] Int. Cl.[5] ..... C22C 14/00

[52] U.S. Cl. ..... 148/421; 420/418; 420/421

[58] Field of Search ..... 420/418, 421; 148/421

[56] References Cited

U.S. PATENT DOCUMENTS

| | | | |
|---|---|---|---|
| 3,203,794 | 8/1965 | Jaffee et al. | 75/175.5 |
| 4,294,615 | 10/1981 | Blackburn et al. | 148/11.5 F |
| 4,639,281 | 1/1987 | Sastry et al. | 148/407 |
| 4,661,316 | 4/1987 | Hashimoto et al. | 420/418 |
| 4,774,052 | 9/1988 | Nagle et al. | 420/590 |
| 4,836,983 | 6/1989 | Huang et al. | 420/418 |
| 4,842,817 | 6/1989 | Huang et al. | 420/418 |
| 4,842,819 | 6/1989 | Huang et al. | 420/418 |
| 4,842,820 | 6/1989 | Huang et al. | 420/418 |
| 4,857,268 | 8/1989 | Huang et al. | 420/418 |
| 4,870,092 | 11/1989 | Huang | 420/418 |
| 4,897,127 | 1/1990 | Huang | 148/421 |
| 4,902,474 | 2/1990 | Huang et al. | 420/418 |
| 4,916,028 | 4/1990 | Huang | 428/614 |
| 4,923,534 | 5/1990 | Huang et al. | 148/407 |
| 5,028,491 | 7/1991 | Huang et al. | 428/614 |
| 5,032,357 | 7/1991 | Rowe | 420/418 |
| 5,045,406 | 11/1991 | Huang | 428/614 |
| 5,196,162 | 3/1993 | Maki et al. | 420/418 |

FOREIGN PATENT DOCUMENTS

| | | |
|---|---|---|
| 621884 | 6/1961 | Canada . |
| 0363598 | 4/1990 | European Pat. Off. . |
| 0405134 | 2/1991 | European Pat. Off. . |
| 0413524 | 2/1991 | European Pat. Off. . |
| 0455005 | 11/1991 | European Pat. Off. . |
| 1255632 | 10/1989 | Japan . |
| 298127 | 12/1989 | Japan . |
| 2219310 | 6/1989 | United Kingdom . |

OTHER PUBLICATIONS

"Effect of TiB2 Additions on the Colony Size of Near Gamma Titanium Aluminides", J. D. Bryant, L. Christodoulou, J. R. Maisano, Scripta Metallurgica et Materialia, vol. 24, (1990) pp. 33-38.

"Influence of Matrix Phase Morphology on Fracture Toughness in a Discontinuously Reinforced XD Titanium Aluminide Composite", Scripta Metallurgica et Materialia, vol. 24, (1990) pp. 851-856.

"The Effects of Alloying on the Microstructure and Properties of Ti3Al and TiAl", Titanium 80, (published by the American Society of Metals, Warrendale, Pa.), vol. 2 (1980) pp. 1245-1254.

"Deformation and Failure in Titanium Aluminide" SM Barinov, ZA Samoilenki, Izvestiya Akademii Nauk SSSR. Metally, No. 3, pp. 164-168, 1984.

"Effect of Rapid Solidification in LloTiAl Compound Alloys", ASM Symposium Proceedings on Enhanced Properties in Struc. Metals Via Rapid Solidification, Materials Week (Oct. 1986), pp. 1-7.

"Titanium Aluminides-An Overview", HA Lispitt, Mat. Res. Soc. Symposium Proc., Materials Research Society, vol. 39, (1985), pp. 351-364.

"Research, Development, and Prospects of TiAl Intermetallic Compound Alloys", T. Tsujimoto, Titanium and Zirconium, vol. 33, No. 3, 159 (Jul. 1985), pp. 1-19.

"Creep Deformation of TiAl and TiAl+W Alloys", PL (List continued on next page.)

*Primary Examiner*—Upendra Roy

*Attorney, Agent, or Firm*—James Magee, Jr.

[57] ABSTRACT

A TiAl composition is prepared to have high strength, high oxidation resistance and to have acceptable ductility by altering the atomic ratio of the titanium and aluminum to have what has been found to be a highly desirable effective aluminum concentration by addition of chromium, niobium, and silicon according to the approximate formula $Ti\text{-}Al_{45}Cr_2Si_2Nb_4$.

14 Claims, 3 Drawing Sheets

OTHER PUBLICATIONS

Martin, MG Mendiratta, HA Lipsitt, Metallurgical Transactions A, vol 14A (Oct. 1983), pp. 2171-2174.

"Plastic Deformation of TiAl and Ti3Al" SML Sastry, HA Lispsitt, Titanium 80 (Published by American Society for Metals, Warrendale, Pa.), vol. 2, (1980), pp. 1231-1243.

"Titanium-Aluminum System", E. S. Bumps, H. D. Kessler, M. Hansen, Transactions AIME, Journal of Metals, Jun. 1952, pp. 609-614.

"Mechanical Properties of High Purity Ti-Al Alloys", H. R. Ogden, D. J. Maykuth, W. L. Finlay, R. I. Jaffee, Transactions AIME, Journal of Metals, Feb. 1953, pp. 267-272.

"Ti-36 Pct Al as a Base for High Temperature Alloys", J. B. McAndrew, J. H. D. Kessler, Transactions AIME, Journal of Metals, Oct. 1956, pp. 1348-1353.

Akademii Nauk Ukrain SSR, Metallofiyikay No. 50 (1974).

"Formation of Alumina on Ti-Al Alloys", R. A. Perkins, K. T. Chiang, G. H. Meier, Scripta Metallurgica, vol. 21, (1987), pp. 1505-1510.

"Temperature Dependence of the Strength and Fracture Toughness of Titanium Aluminum", Izv. Akad. Nauk SSSR, Met., vol. 5, 1983, p. 170.

CAST GAMMA TITANIUM ALUMINUM ALLOYS MODIFIED BY CHROMIUM, NIOBIUM, AND SILICON, AND METHOD OF PREPARATION

CROSS REFERENCE TO RELATED APPLICATIONS

The subject application relates to the copending applications as follows:

Ser. No. 07/801,558, filed Dec. 2, 1991; Ser. No. 07/811,371, filed Dec. 20, 1991; and Ser. No. 07/801,557, filed Dec. 2, 1991, now U.S. Pat. 5,205,875. Ser. Nos. 07/546,962, and 07/546,973, both filed Jul. 2, 1990; Ser. Nos. 07/589,823, and 07/589,827, both filed Sep. 26, 1990; Ser. No. 07/613,494, filed Jun. 12, 1991; Ser. Nos. 07/631,988, and 07/631,989, both filed Dec. 21, 1990; Ser. No. 07/695,043, filed May 2, 1991; and Ser. No. 07/739,004, filed Aug. 1, 1991.

The text of these related applications are incorporated herein by reference.

BACKGROUND OF THE INVENTION

The present invention relates generally to alloys of titanium and aluminum. More particularly, it relates to gamma alloys of titanium and aluminum which have been modified both with respect to stoichiometric ratio and with respect to silicon, chromium, and niobium additions.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_3Al$ is formed. The $Ti_3Al$ has an ordered hexagonal crystal form called alpha-2. At still higher concentrations of aluminum (including the range of 50 to 60 atomic % aluminum) another intermetallic compound, TiAl, is formed having an ordered tetragonal crystal form called gamma. The gamma compound, as modified, is the subject matter of the present invention.

The alloy of titanium and aluminum having a gamma crystal form, and a stoichiometric ratio of approximately one, is an intermetallic compound having a high modulus, a low density, a high thermal conductivity, favorable oxidation resistance, and good creep resistance. The relationship between the modulus and temperature for TiAl compounds to other alloys of titanium and in relation to nickel base superalloys is shown in FIG. 3. As is evident from the FIGURE, the TiAl has the best modulus of any of the titanium alloys. Not only is the TiAl modulus higher at higher temperature but the rate of decrease of the modulus with temperature increase is lower for TiAl than for the other titanium alloys. Moreover, the TiAl retains a useful modulus at temperatures above those at which the other titanium alloys become useless. Alloys which are based on the TiAl intermetallic compound are attractive lightweight materials for use where high modulus is required at high temperatures and where good environmental protection is also required.

One of the characteristics of TiAl which limits its actual application to such uses is a brittleness which is found to occur at room temperature. Also, the strength of the intermetallic compound at room temperature can use improvement before the TiAl intermetallic compound can be exploited in certain structural component applications. Improvements of the gamma TiAl intermetallic compound to enhance ductility and/or strength at room temperature are very highly desirable in order to permit use of the compositions at the higher temperatures for which they are suitable.

With potential benefits of use at light weight and at high temperatures, what is most desired in the TiAl compositions which are to be used is a combination of strength and ductility at room temperature. A minimum ductility of the order of one percent is acceptable for some applications of the metal composition but higher ductilities are much more desirable. A minimum strength for a composition to be useful is about 50 ksi or about 350 MPa. However, materials having this level of strength are of marginal utility for certain applications and higher strengths are often preferred for some applications.

The stoichiometric ratio of gamma TiAl compounds can vary over a range without altering the crystal structure. The aluminum content can vary from about 50 to about 60 atom percent. The properties of gamma TiAl compositions are, however, subject to very significant changes as a result of relatively small changes of one percent or more in the stoichiometric ratio of the titanium and aluminum ingredients. Also, the properties are similarly significantly affected by the addition of relatively similar small amounts of ternary, quaternary, and other elements.

I have now discovered that further improvements can be made in the gamma TiAl intermetallic compounds by incorporating therein certain combinations of additive elements and particularly chromium, niobium, and silicon to accord desirable properties to the compositions in the cast form.

Furthermore, I have discovered that the composition including the additive elements has a uniquely desirable combination of properties which include a substantially improved strength and a desirably high ductility in the cast state.

PRIOR ART

There is extensive literature on the compositions of titanium aluminum including the $Ti_3Al$ intermetallic compound, the TiAl intermetallic compounds and the $TiAl_3$ intermetallic compound. A patent, U.S. Pat. No. 4,294,615, entitled "TITANIUM ALLOYS OF THE TiAl TYPE" contains an extensive discussion of the titanium aluminide type alloys including the TiAl intermetallic compound. As is pointed out in the patent in column 1, starting at line 50, in discussing TiAl's advantages and disadvantages relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

"Those well skilled recognize that there is a substantial difference between the two ordered phases. Alloying and transformational behavior of $Ti_3Al$ resemble those of titanium, as the hexagonal crystal structures are very similar. However, the compound TiAl has a tetragonal arrangement of atoms and thus rather different alloying characteristics. Such a distinction is often not recognized in the earlier literature."

The '615 patent does describe the alloying of TiAl with vanadium and carbon to achieve some property improvements in the resulting alloy.

The '615 patent does not disclose alloying TiAl with silicon or with chromium nor with a combination of silicon and chromium, and particularly does not disclose combinations of silicon, chromium, and niobium.

A number of technical publications dealing with the titanium aluminum compounds as well as with the characteristics of these compounds are as follows:

1. E. S. Bumps, H. D. Kessler, and M. Hansen, "Titanium-Aluminum System", Journal of Metals, June 1952, pp. 609-614, TRANSACTIONS AIME, Vol. 194.
2. H. R. Ogden, D. J. Maykuth, W. L. Finlay, and R. I. Jaffee, "Mechanical Properties of High Purity Ti-Al Alloys", Journal of Metals, February 1953, pp. 267-272, TRANSACTIONS AIME, Vol. 197.
3. Joseph B. McAndrew, and H. D. Kessler, "Ti-36 Pct Al as a Base for High Temperature Alloys", Journal of Metals, October 1956, pp. 1348-1353, TRANSACTIONS AIME, Vol. 206.
4. Patrick L. Martin, Madan G. Mendiratta, and Harry A. Lispitt, "Creep Deformation of TiAl and TiAl+W Alloys", Metallurgical Transactions A, Volume 14A (October 1983) pp. 2171-2174.
5. P. L. Martin, H. A. Lispitt, N. T. Nuhfer, and J. C. Williams, "The Effects of Alloying on the Microstructure and Properties of $Ti_3Al$ and TiAl", *Titanium* 80, (Published by American Society for Metals, Warrendale, Pa.), Vol. 2, pp. 1245-1254.
6. R. A. Perkins, K. T. Chiang, and G. H. Meier, "Formulation of Alumina on Ti-Al Alloys", Scripta METALLURGICA, Vol. 21 (1987) pages 1505-1510.

A discussion of oxidative influences and the effect of additives, including tantalum, on oxidation is contained starting on page 1350 of the Journal of Metals, October 1956, Transactions AIME.
7. S. M. Barinov, T. T. Nartova, Yu L. Krasulin, and T. V. Mogutova, "Temperature Dependence of the Strength and Fracture Toughness of Titanium Aluminum", Izv. Akad. Nauk SSSR, *Met.*, Vol. 5 (1983) p. 170.

In reference 7, Table I, a composition of titanium-36 aluminum-0.01 boron is reported and this composition is reported to have an improved ductility. This composition corresponds in atomic percent to $Ti_{50}Al_{49.97}B_{0.03}$.
8. S. M. L. Sastry, and H. A. Lispitt, "Plastic Deformation of TiAl and $Ti_3Al$", Titanium 80 (Published by American Society for Metals, Warrendale, PA), Vol. 2 (1980) page 1231.
9. Tokuzo Tsujimoto, "Research, Development, and Prospects of TiAl Intermetallic Compound Alloys", Titanium and Zirconium, Vol. 33, No. 3, 159 (July 1985) pp. 1-13.
10. H. A. Lispitt, "Titanium Aluminides—An Overview", Mat. Res. Soc. Symposium Proc., Materials Research Society, Vol. 39 (1985) pp. 351-364.
11. S. H. Whang et al., "Effect of Rapid Solidification in $Ll_0$TiAl Compound Alloys", ASM Symposium Proceedings on Enhanced Properties in Struc. Metals Via Rapid Solidification, Materials Week (October 1986) pp. 1-7.
12. Izvestiya Akademii Nauk SSR, Metally. No. 3 (1984) pp. 164-168.
13. D. E. Larsen, M. L. Adams, S. L. Kampe, L. Christodoulou, and J. D. Bryant, "Influence of Matrix Phase Morphology on Fracture Toughness in a Discontinuously Reinforced XD TM Titanium Aluminide Composite", Scripta Metallurgica et Materialia, Vol. 24, (1990) pp. 851-856.
14. Akademii Nauk Ukrain SSR, Metallofiyikay No. 50 (1974).
15. J. D. Bryant, L. Christodon, and J. R. Maisano, "Effect of $TiB_2$ Additions on the Colony Size of Near Gamma Titanium Aluminides", Scripta Metallurgica et Materialia, Vol. 24 (1990) pp. 33-38.

U.S. Pat. No. 3,203,794 to Jaffee discloses a TiAl composition containing silicon and a separate TiAl composition containing chromium.

Canadian Patent 621884 to Jaffee similarly discloses a composition of TiAl containing chromium and a separate composition of TiAl containing silicon in Table 1.

The Jaffee patents contains no hint or suggestion of TiAl compositions containing a combination of chromium and silicon and particularly not of chromium, silicon, and niobium.

U.S. Pat. No. 4,661,316 to Hashimoto teaches doping of TiAl with 0.1 to 5.0 weight percent of manganese, as well as doping TiAl with combinations of other elements with manganese. The Hashianoto patent does not teach the doping of TiAl with chromium or with combinations of elements including chromium and particularly not a combination of chromium with silicon and niobium.

Canadian Patent 62,884 to Jaffee discloses a composition containing chromium in TiAl in Table 1 of the patent. Jaffee also discloses a separate composition in Table 1 containing tantalum in TiAl as well as about 26 other TiAl compositions containing additives in TiAl. There is no disclosure in the Jaffee Canadian patent of any TiAl compositions containing combinations of elements with chromium or of combinations of elements with niobium. There is particularly no disclosure or hint or suggestion of a TiAl composition containing a combination of chromium, silicon, and niobium.

A number of commonly owned patents relating to titanium aluminides and to methods and compositions for improving the properties of such aluminides. These patents include U.S. Pat. Nos. 4,836,983; 4,842,819; 4,842,820; 4,857,268; 4,879,092; 4,897,127; 4,902,474, 4,916,028; 4,923,534; 5,032,357; 5,045,406; and U.S. Pat. No. 4,842,817 to S. C. Huang and M. F. X. Gigliotti. And, commonly owned U.S. Pat. No. 5,028,491 teaches improvements in titanium aluminides through additions of chromium and niobium. The texts of these commonly owned patents are incorporated herein by reference.

A number of other patents also deal with TiAl compositions as follows:

U.S. Pat. No. 3,203,794 to Jaffee discloses various TiAl compositions.

U.S. Pat. No. 4,639,281 to Sastry teaches inclusion of fibrous dispersoids of boron, carbon, nitrogen, and mixtures thereof or mixtures thereof with silicon in a titanium base alloy including Ti-Al.

U.S. Pat. No. 4,774,052 to Nagle concerns a method of incorporating a ceramic, including boride, in a matrix by means of an exothermic reaction to impart a second phase material to a matrix material including titanium aluminides.

Japanese Hokai Patent No. Hei 1 (1989) 298127 discloses the independent use of niobium with boron and the separate independent use of chromium with boron as additives among other additives to titanium aluminide.

BRIEF DESCRIPTION OF THE INVENTION

In one of its broader aspects, the objects of the present invention are achieved by providing a nonstoichiometric TiAl base alloy, and adding a relatively low concentration of chromium, a low concentration of silicon and a moderate concentration of niobium to the nonstoichiometric composition. Addition of chromium in the order of approximately 1 to 3 atomic percent, of niobium in the order of 2 to 6 atomic percent, and of silicon to the extent of 1 to 4 atomic percent is contemplated.

The alloy of this invention is particularly adapted to being produced in cast form and may be HIPed and otherwise processed by ingot metallurgy. The additions may alternatively be followed by rapidly solidifying the chromium-containing nonstoichiometric TiAl intermetallic compound.

BRIEF DESCRIPTION OF THE DRAWINGS

The detailed description of the invention which follows will be understood with greater clarity if reference is made to the accompanying drawings in which.

DETAILED DESCRIPTION OF THE INVENTION

Figure 1:
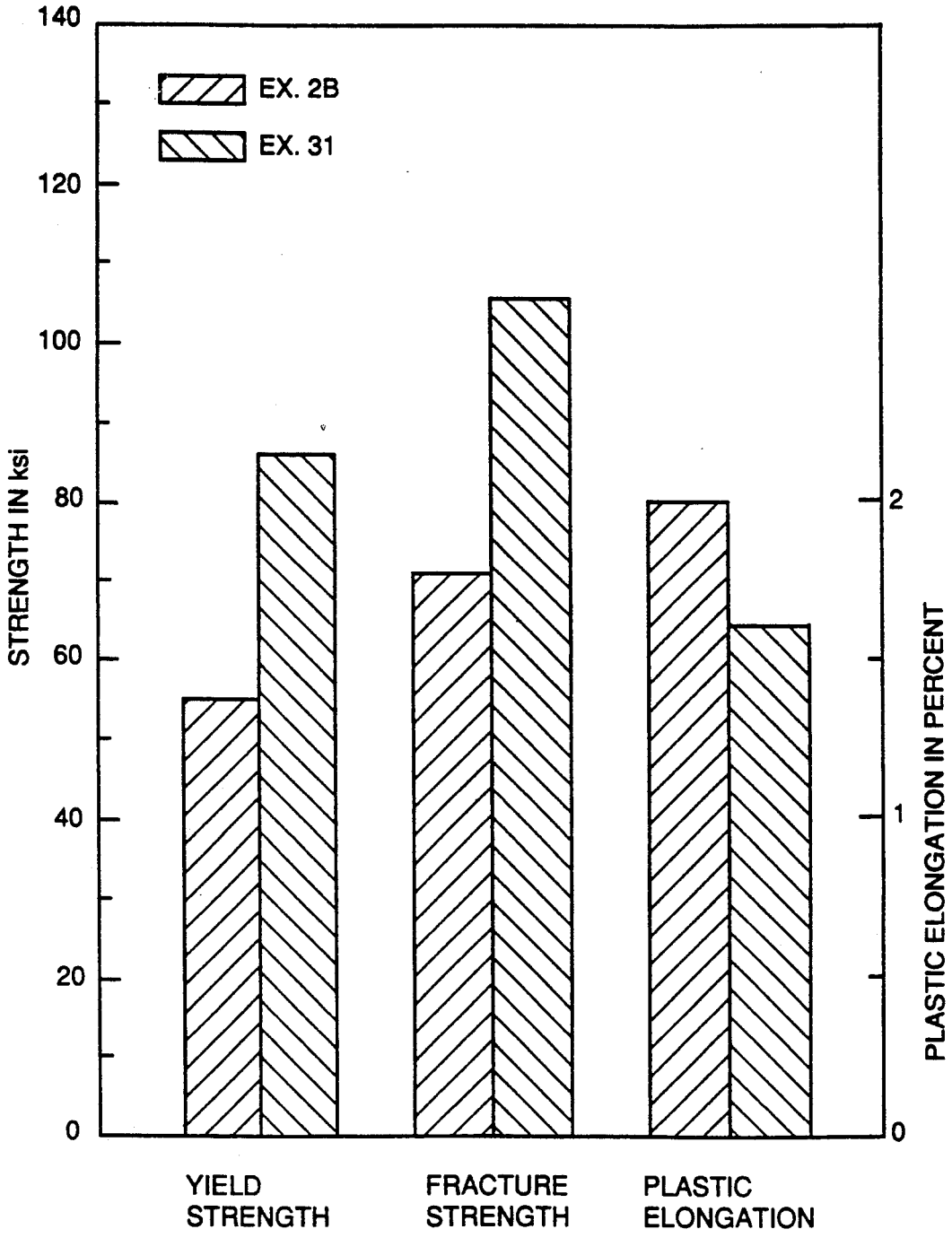
FIG. 1 is a bar graph displaying comparative data for a novel alloy composition of this invention and a reference alloy.

There are a series of background and current studies which led to the findings on which the present invention, involving the combined addition of silicon, niobium, and chromium to a gamma TiAl are based. The first twenty five examples deal with the background studies and the later examples deal with the current studies.

EXAMPLES 1-3

Three individual melts were prepared to contain titanium and aluminum in various stoichiometric ratios approximating that of TiAl. The compositions, annealing temperatures and test results of tests made on the compositions are set forth in Table I.

For each example, the alloy was first made into an ingot by electro arc melting. The ingot was processed into ribbon by melt spinning in a partial pressure of argon. In both stages of the melting, a water-cooled copper hearth was used as the container for the melt in order to avoid undesirable melt-container reactions. Also, care was used to avoid exposure of the hot metal to oxygen because of the strong affinity of titanium for oxygen.

The rapidly solidified ribbon was packed into a steel can which was evacuated and then sealed. The can was then hot isostatically pressed (HIPped) at 950° C. (1740° F.) for 3 hours under a pressure of 30 ksi. The HIPping can was machined off the consolidated ribbon plug. The HIPped sample was a plug about one inch in diameter and three inches long.

The plug was placed axially into a center opening of a billet and sealed therein. The billet was heated to 975° C. (1787° F.) and was extruded through a die to give a reduction ratio of about 7 to 1. The extruded plug was removed from the billet and was heat treated.

The extruded samples were then annealed at temperatures as indicated in Table I for two hours. The annealing was followed by aging at 1000° C. for two hours. Specimens were machined to the dimension of 1.5×3×25.4 mm (0.060×0.120×1.0 in.) for four point bending tests at room temperature. The bending tests were carried out in a 4-point bending fixture having an inner span of 10 mm (0.4 in.) and an outer span of 20 mm (0.8 in.). The load-crosshead displacement curves were recorded. Based on the curves developed, the following properties are defined:

(1) Yield strength is the flow stress at a cross head displacement of one thousandth of an inch. This amount of cross head displacement is taken as the first evidence of plastic deformation and the transition from elastic deformation to plastic deformation. The measurement of yield and/or fracture strength by conventional compression or tension methods tends to give results which are lower than the results obtained by four point bending as carried out in making the measurements reported herein. The higher levels of the results from four point bending measurements should be kept in mind when comparing these values to values obtained by the conventional compression or tension methods. However, the comparison of measurements' results in many of the examples herein is between four point bending tests, and for all samples measured by this technique, such comparisons are quite valid in establishing the differences in strength properties resulting from differences in composition or in processing of the compositions.

(2) Fracture strength is the stress to fracture.

(3) Outer fiber strain is the quantity of 9.71 hd, where "h" is the specimen thickness in inches, and "d" is the cross head displacement of fracture in inches. Metallurgically, the value calculated represents the amount of plastic deformation experienced at the outer surface of the bending specimen at the time of fracture.

Figure 2:
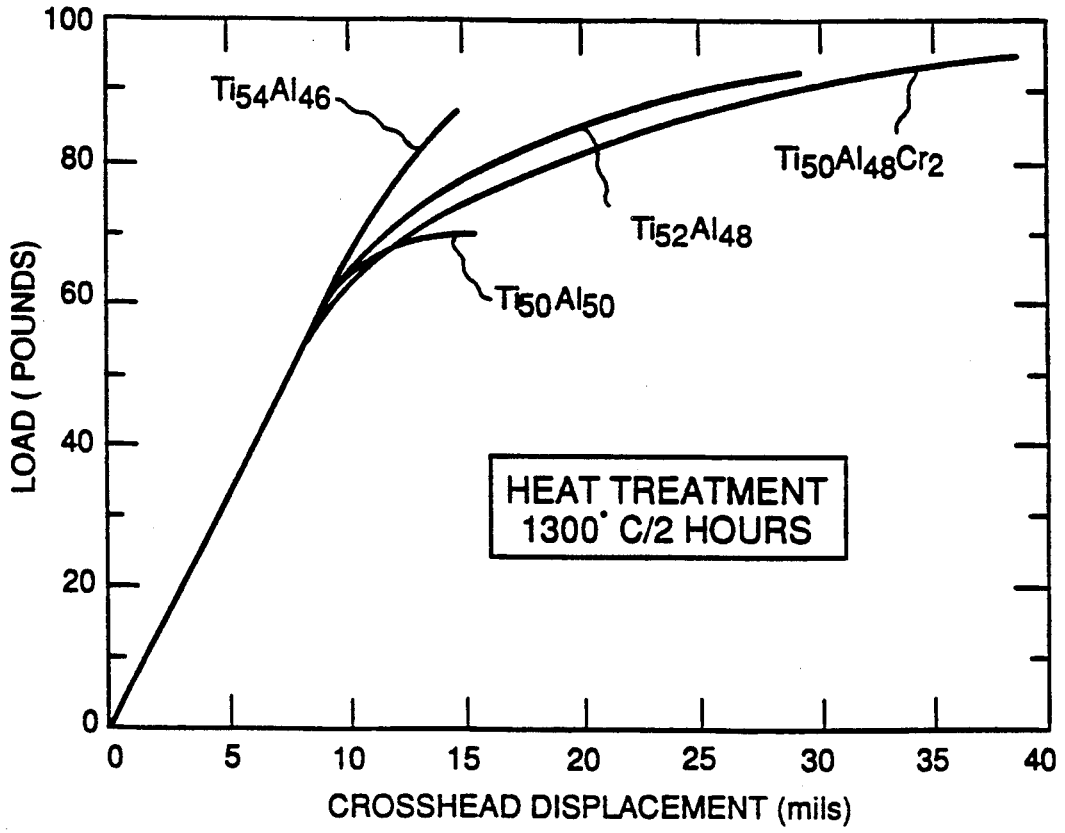
FIG. 2 is a graph illustrating the relationship between load in pounds and crosshead displacement in mils for TiAl compositions of different stoichiometry tested in 4-point bending and for $Ti_{50}Al_{48}Cr_2$.
Figure 3:
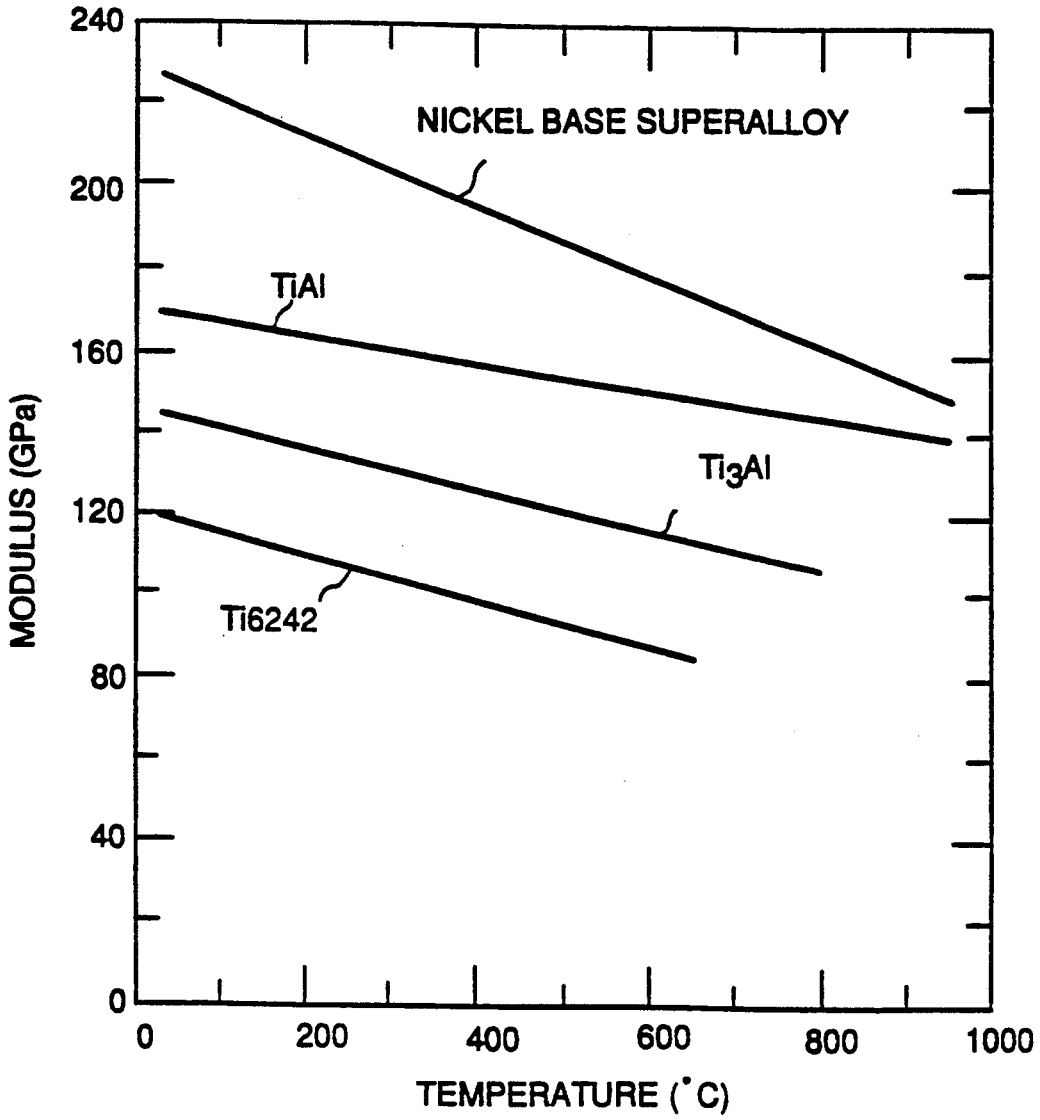
FIG. 3 is a graph illustrating the relationship between modulus and temperature for an assortment of alloys.

The results are listed in the following Table I. Table I contains data on the properties of samples annealed at 1300° C. and further data on these samples in particular is given in FIG. 2.

TABLE I

| Ex. No. | Gamma Alloy No. | Composit. (at. %) | Anneal Temp (°C.) | Yield Strength (ksi) | Fracture Strength (ksi) | Outer Fiber Strain (%) |
|---|---|---|---|---|---|---|
| 1 | 83 | $Ti_{54}Al_{46}$ | 1250 | 131 | 132 | 0.1 |
| | | | 1300 | 111 | 120 | 0.1 |
| | | | 1350 | * | 58 | 0 |

TABLE I-continued

| Ex. | Gamma Alloy | Com-posit. | Anneal Temp | Yield Strength | Fracture Strength | Outer Fiber Strain |
|---|---|---|---|---|---|---|
| | | | | | | |
| | | | | | | |
| | | | | | | |

Accordingly, the nature of the substitution which takes place is very important but is also highly unpredictable.

Another parameter of this set is the concentration of the additive.

Still another parameter evident from Table II is the annealing temperature. The annealing temperature which produces the best strength properties for one additive can be seen to be different for a different additive. This can be seen by comparing the results set forth in Example 6 with those set forth in Example 7.

In addition, there may be a combined concentration and annealing effect for the additive so that optimum property enhancement, if any enhancement is found, can occur at a certain combination of additive concentration and annealing temperature so that higher and lower concentrations and/or annealing temperatures are less effective in providing a desired property improvement.

The content of Table II makes clear that the results obtainable from addition of a ternary element to a non-stoichiometric TiAl composition are highly unpredictable and that most test results are unsuccessful with respect to ductility or strength or to both.

EXAMPLES 14-17

A further parameter of the gamma titanium aluminide alloys which include additives is that combinations of additives do not necessarily result in additive combinations of the individual advantages resulting from the individual and separate inclusion of the same additives.

Four additional TiAl based samples were prepared as described above with reference to Examples 1-3 to contain individual additions of vanadium, niobium, and tantalum as listed in Table III. These compositions are the optimum compositions reported in commonly owned U.S. Pat. Nos. 4,842,817 and 4,857,268.

The fourth composition is a composition which combines the vanadium, niobium and tantalum into a single alloy designated in Table III to be alloy 48.

From Table III, it is evident that the individual additions vanadium, niobium and tantalum are able on an individual basis in Examples 14, 15, and 16 to each lend substantial improvement to the base TiAl alloy. However, these same additives when combined into a single combination alloy do not result in a combination of the individual improvements in an additive fashion. Quite the reverse is the case.

In the first place, the alloy 48 which was annealed at the 1350° C. temperature used in annealing the individual alloys was found to result in production of such a brittle material that it fractured during machining to prepare test specimens.

Secondly, the results which are obtained for the combined additive alloy annealed at 1250° C. are very inferior to those which are obtained for the separate alloys containing the individual additives.

In particular, with reference to the ductility, it is evident that the vanadium was very successful in substantially improving the ductility in the alloy 14 of Example 14. However, when the vanadium is combined with the other additives in alloy 48 of Example 17, the ductility improvement which might have been achieved is not achieved at all. In fact, the ductility of the base alloy is reduced to a value of 0.1.

Further, with reference to the oxidation resistance, the niobium additive of alloy 40 clearly shows a very substantial improvement in the 4 mg/cm2 weight loss of alloy 40 as compared to the 31 mg/cm2 weight loss of the base alloy. The test of oxidation, and the complementary test of oxidation resistance, involves heating a sample to be tested at a temperature of 982° C. for a period of 48 hours. After the sample has cooled, it is scraped to remove any oxide scale. By weighing the sample both before and after the heating and scraping, a weight difference can be determined. Weight loss is determined in mg/cm2 by dividing the total weight loss in grams by the surface area of the specimen in square centimeters. This oxidation test is the one used for all measurements of oxidation or oxidation resistance as set forth in this application.

For the alloy 60 with the tantalum additive, the weight loss for a sample annealed at 1325° C. was determined to be 2 mg/cm2 and this is again compared to the 31 mg/cm2 weight loss for the base alloy. In other words, on an individual additive basis both niobium and tantalum additives were very effective in improving oxidation resistance of the base alloy.

However, as is evident from Example 17, results listed in Table III alloy 48 which contained all three additives, vanadium, niobium and tantalum in combination, the oxidation is increased to about double that of the base alloy. This is seven times greater than alloy 40 which contained the niobium additive alone and about 15 times greater than alloy 60 which contained the tantalum additive alone.

TABLE III

| Ex. No. | Gamma Alloy No. | Composit. (at. %) | Anneal Temp (°C.) | Yield Strength (ksi) | Fracture Strength (ksi) | Outer Fiber Strain (%) | Weight Loss After 48 hours @98° C. ($mg/cm^2$) |
|---|---|---|---|---|---|---|---|
| 2 | 12 | $Ti_{52}Al_{48}$ | 1250 | 130 | 180 | 1.1 | * |
| | | | 1300 | 98 | 128 | 0.9 | * |
| | | | 1350 | 88 | 122 | 0.9 | 31 |
| 14 | 14 | $Ti_{49}Al_{48}V_3$ | 1300 | 94 | 145 | 1.6 | 27 |
| | | | 1350 | 84 | 136 | 1.5 | * |
| 15 | 40 | $Ti_{50}Al_{46}Nb_4$ | 1250 | 136 | 167 | 0.5 | * |
| | | | 1300 | 124 | 176 | 1.0 | 4 |
| | | | 1350 | 86 | 100 | 0.1 | * |
| 16 | 60 | $Ti_{48}Al_{48}Ta_4$ | 1250 | 120 | 147 | 1.1 | * |
| | | | 1300 | 106 | 141 | 1.3 | * |
| | | | 1325 | * | * | * | * |
| | | | 1325 | * | * | * | 2 |
| | | | 1350 | 97 | 137 | 1.5 | * |
| | | | 1400 | 72 | 92 | 0.2 | * |
| 17 | 48 | $Ti_{49}Al_{45}V_2Nb_2Ta_2$ | 1250 | 106 | 107 | 0.1 | 60 |

TABLE III-continued

| Ex. No. | Gamma Alloy No. | Composit. (at. %) | Anneal Temp (°C.) | Yield Strength (ksi) | Fracture Strength (ksi) | Outer Fiber Strain (%) | Weight Loss After 48 hours @98° C. (mg/cm$^2$) |
|---|---|---|---|---|---|---|---|
| | | | 1350 | + | + | + | * |

* - Not measured
+ - Material fractured during machining to prepare test specimen The individual advantages or disadvantages which result from the use of individual additives repeat reliably as these additives are used individually over and over again. However, when additives are used in combination the effect of an additive in the combination in a base alloy can be quite different from the effect of the additive when used individually and separately in the same base alloy. Thus, it has been discovered that addition of vanadium is beneficial to the ductility of titanium aluminum compositions and this is disclosed and discussed in the commonly owned U.S. Pat. No. 4,857,268. Further, one of the additives which has been found to be beneficial to the strength of the TiAl base is the additive niobium. In addition, it has been shown by the McAndrew paper discussed above that the individual addition of niobium additive to TiAl base alloy can improve oxidation resistance. Similarly, the individual addition of tantalum is taught by McAndrew as assisting in improving oxidation resistance. Furthermore, in commonly owned U.S. Pat. No. 4,842,817, it is disclosed that addition of tantalum results in improvements in ductility.

In other words, it has been found that vanadium can individually contribute advantageous ductility improvements to gamma titanium aluminum compound and that tantalum can individually contribute to ductility and oxidation improvements. It has been found separately that niobium additives can contribute beneficially to the strength and oxidation resistance properties of titanium aluminum. However, as is indicated from this Example 17, when vanadium, tantalum, and niobium are used together and are combined as additives in an alloy composition, the alloy composition is not benefited by the additions but rather there is a net decrease or loss in properties of the TiAl which contains the niobium, the tantalum, and the vanadium additives. This is evident from the data of Table III.

From this, it is evident that, while it may seem that if two or more additive elements individually improve TiAl that their use together should render further improvements to the TiAl, it is found, nevertheless, that such additions are highly unpredictable and that, in fact, for the combined additions of vanadium, niobium and tantalum a net loss of properties result from the combined use of the combined additives together rather than resulting in some combined beneficial overall gain of properties.

However, from Table III above, it is evident that the alloy containing the combination of the vanadium, niobium and tantalum additions has far worse oxidation resistance than the base TiAl 12 alloy of Example 2. Here, again, the combined inclusion of additives which improve a property on a separate and individual basis have been found to result in a net loss in the very property which is improved when the additives are included on a separate and individual basis.

EXAMPLES 18 thru 23

Six additional samples were prepared as described above with reference to Examples 1-3 to contain chromium modified titanium aluminide having compositions respectively as listed in Table IV.

Table IV summarizes the bend test results on all of the alloys, both standard and modified, under the various heat treatment conditions deemed relevant.

TABLE IV

| Ex. No. | Gamma Alloy No. | Composit. (at. %) | Anneal Temp (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 18 | 38 | $Ti_{52}Al_{46}Cr_2$ | 1250 | 113 | 170 | 1.6 |
| | | | 1300 | 91 | 123 | 0.4 |
| | | | 1350 | 71 | 89 | 0.2 |
| 19 | 80 | $Ti_{50}Al_{48}Cr_2$ | 1250 | 97 | 131 | 1.2 |
| | | | 1300 | 89 | 135 | 1.5 |
| | | | 1350 | 93 | 108 | 0.2 |
| 20 | 87 | $Ti_{48}Al_{50}Cr_2$ | 1250 | 108 | 122 | 0.4 |
| | | | 1300 | 106 | 121 | 0.3 |
| | | | 1350 | 100 | 125 | 0.7 |
| 21 | 49 | $Ti_{50}Al_{46}Cr_4$ | 1250 | 104 | 107 | 0.1 |
| | | | 1300 | 90 | 116 | 0.3 |
| 22 | 79 | $Ti_{48}Al_{48}Cr_4$ | 1250 | 122 | 112 | 0.3 |
| | | | 1300 | 111 | 135 | 0.4 |
| | | | 1350 | 61 | 74 | 0.2 |
| 23 | 88 | $Ti_{46}Al_{50}Cr_4$ | 1250 | 128 | 139 | 0.2 |
| | | | 1300 | 122 | 133 | 0.2 |
| | | | 1350 | 113 | 131 | 0.3 |

The results listed in Table IV offer further evidence of the criticality of a combination of factors in determining the effects of alloying additions or doping additions on the properties imparted to a base alloy. For example, the alloy 80 shows a good set of properties for a 2 atomic percent addition of chromium. One might expect further improvement from further chromium addition. However, the addition of 4 atomic percent chromium to alloys having three different TiAl atomic ratios demonstrates that the increase in concentration of an additive found to be beneficial at lower concentrations does not follow the simple reasoning that if some is good, more must be better. And, in fact, for the chromium additive just the opposite is true and demonstrates that where some is good, more is bad.

As is evident from Table IV, each of the alloys 49, 79 and 88, which contain "more" (4 atomic percent) chromium shows inferior strength and also inferior outer fiber strain (ductility) compared with the base alloy.

By contrast, alloy 38 of Example 18 contains 2 atomic percent of additive and shows only slightly reduced strength but greatly improved ductility. Also, it can be observed that the measured outer fiber strain of alloy 38 varied significantly with the heat treatment conditions. A remarkable increase in the outer fiber strain was achieved by annealing at 1250° C. Reduced strain was observed when annealing at higher temperatures. Similar improvements were observed for alloy 80 which also contained only 2 atomic percent of additive although the annealing temperature was 1300° C. for the highest ductility achieved.

For Example 20, alloy 87 employed the level of 2 atomic percent of chromium but the concentration of aluminum is increased to 50 atomic percent. The higher aluminum concentration leads to a small reduction in the ductility from the ductility measured for the two percent chromium compositions with aluminum in the 46 to 48 atomic percent range. For alloy 87, the optimum heat treatment temperature was found to be about 1350° C.

From Examples 18, 19 and 20, which each contained 2 atomic percent additive, it was observed that the optimum annealing temperature increased with increasing aluminum concentration.

From this data it was determined that alloy 38 which has been heat treated at 1250° C., had the best combination of room temperature properties. Note that the optimum annealing temperature for alloy 38 with 46 at. % aluminum was 1250° C. but the optimum for alloy 80 with 48 at. % aluminum was 1300° C. The data obtained for alloy 80 is plotted in FIG. 2 relative to the base alloys.

These remarkable increases in the ductility of alloy 38 on treatment at 1250° C. and of alloy 80 on heat treatment at 1300° C. were unexpected as is explained in the commonly owned U.S. Pat. No. 4,842,819.

What is clear from the data contained in Table IV is that the modification of TiAl compositions to improve the properties of the compositions is a very complex and unpredictable undertaking. For example, it is evident that chromium at 2 atomic percent level does very substantially increase the ductility of the composition where the atomic ratio of TiAl is in an appropriate range and where the temperature of annealing of the composition is in an appropriate range for the chromium additions. It is also clear from the data of Table IV that, although one might expect greater effect in improving properties by increasing the level of additive, just the reverse is the case because the increase in ductility which is achieved at the 2 atomic percent level is reversed and lost when the chromium is increased to the 4 atomic percent level. Further, it is clear that the 4 percent level is not effective in improving the TiAl properties even though a substantial variation is made in the atomic ratio of the titanium to the aluminum and a substantial range of annealing temperatures is employed in studying the testing the change in properties which attend the addition of the higher concentration of the additive.

EXAMPLE 24

Samples of alloys were prepared which had a composition as follows:

$Ti_{52}Al_{46}Cr_2$.

Test samples of the alloy were prepared by two different preparation modes or methods and the properties of each sample were measured by tensile testing. The methods used and results obtained are listed in Table V immediately below.

TABLE V

| Ex. No. | Alloy No. | Composition (at. %) | Processing Method | Anneal Temp (°C.) | Yield Strength (ksi) | Tensile Strength (ksi) | Plastic Elongation (%) |
|---|---|---|---|---|---|---|---|
| 18' | 38 | $Ti_{52}Al_{46}Cr_2$ | Rapid Solidification | 1250 | 93 | 108 | 1.5 |
| 24 | 38 | $Ti_{52}Al_{46}Cr_2$ | Cast & Forge | 1225 | 77 | 99 | 3.5 |
| | | | Ingot | 1250 | 74 | 99 | 3.8 |
| | | | Metallurgy | 1275 | 74 | 97 | 2.6 |

In Table V, the results are listed for alloy samples 38 which were prepared according to two Examples, 18' and 24, which employed two different and distinct alloy preparation methods in order to form the alloy of the respective examples. In addition, test methods were employed for the metal specimens prepared from the alloy 38 of Example 18' and separately for alloy 38 of Example 24 which are different from the test methods used for the specimens of the previous examples.

Turning now first to Example 18', the alloy of this example was prepared by the method set forth above with reference to Examples 1-3. This is a rapid solidification and consolidation method. In addition for Example 18', the testing was not done according to the 4 point bending test which is used for all of the other data reported in the tables above and particularly for Example 18 of Table IV above. Rather the testing method employed was a more conventional tensile testing according to which a metal samples are prepared as tensile bars and subjected to a pulling tensile test until the metal elongates and eventually breaks. For example, again with reference to Example 18' of Table V, the alloy 38 was prepared into tensile bars and the tensile bars were subjected to a tensile force until there was a yield or extension of the bar at 93 ksi.

The yield strength in ksi of Example 18' of Table V, measured by a tensile bar, compares to the yield strength in ksi of Example 18 of Table IV which was measured by the 4 point bending test. In general, in metallurgical practice, the yield strength determined by tensile bar elongation is a more generally used and more generally accepted measure for engineering purposes.

Similarly, the tensile strength in ksi of 108 represents the strength at which the tensile bar of Example 18' of Table V broke as a result of the pulling. This measure is referenced to the fracture strength in ksi for Example 18 in Table IV. It is evident that the two different tests result in two different measures for all of the data.

With regard next to the plastic elongation, here again there is a correlation between the results which are determined by 4 point bending tests as set forth in Table IV above for Example 18 and the plastic elongation in percent set forth in the last column of Table V for Example 18'.

Referring again now to Table V, the Example 24 is indicated under the heading "Processing Method" to be prepared by cast and forge ingot metallurgy. As used herein, the term "cast and forge ingot metallurgy" refers to a melting of the ingredients of the alloy 38 in the proportions set forth in Table V and corresponding exactly to the proportions set forth for Example 18'. In other words, the composition of alloy 38 for both Example 18' and for Example 24 are identically the same. The difference between the two examples is that the alloy of Example 18' was prepared by rapid solidification and the alloy of Example 24 was prepared by cast and forge ingot metallurgy. Again, the cast and forge ingot metallurgy involves a melting of the ingredients and solidification of the ingredients into an ingot followed by forging. The rapid solidification method involves the formation of a ribbon by the melt spinning method followed by the consolidation of the ribbon into a fully dense coherent metal sample.

In the cast and forge ingot melting procedure of Example 24 the ingot is prepared to a dimension of about 2" in diameter and about ½" thick in the approximate shape of a hockey puck. Following the melting and solidification of the hockey puck-shaped ingot, the ingot was enclosed within a steel annulus having a wall thickness of about ½" and having a vertical thickness which matched identically that of the hockey puck-shaped ingot. Before being enclosed within the retaining ring the hockey puck ingot was homogenized by being heated to 1250° C. for two hours. The assembly of the hockey puck and containing ring were heated to a temperature of about 975° C. The heated sample and containing ring were forged to a thickness of approximately half that of the original thickness. This procedure is referred to herein as a cast and forge processing.

Following the forging and cooling of the specimen, tensile specimens were prepared corresponding to the tensile specimens prepared for Example 18'. These tensile specimens were subjected to the same conventional tensile testing as was employed in Example 18' and the yield strength, tensile strength and plastic elongation measurements resulting from these tests are listed in Table V for Example 24. As is evident from the Table V results the individual test samples were subjected to different annealing temperatures prior to performing the actual tensile tests.

For Example 18' of Table V, the annealing temperature employed on the tensile test specimen was 1250° C. For the three samples of the alloy 38 of Example 24 of Table V, the samples were individually annealed at the three different temperatures listed in Table V and specifically 1225° C., 1250° C., and 1275° C. Following this annealing treatment for approximately two hours, the samples were subjected to conventional tensile testing and the results again are listed in Table V for the three separately treated tensile test specimens.

Turning now again to the test results which are listed in Table V, it is evident that the yield strengths determined for the rapidly solidified alloy are somewhat higher than those which are determined for the cast and forge ingot processed metal specimens. Also, it is evident that the plastic elongation of the samples prepared through the cast and forge ingot metallurgy route have generally higher ductility than those which are prepared by the rapid solidification route. The results listed for Example 24 demonstrate that although the yield strength measurements are somewhat lower than those of Example 18' they are fully adequate for many applications in aircraft engines and in other industrial uses. However, based on the ductility measurements and the results of the measurements as listed in Table V the gain in ductility makes the alloy 38 as prepared through the cast and forge ingot metallurgy route a very desirable and unique alloy for those applications which require a higher ductility. Generally speaking, it is well-known that processing by cast and forge ingot metallurgy is far less expensive than processing through melt spinning or rapid solidification inasmuch as there is no need for the expensive melt spinning step itself nor for the consolidation step which must follow the melt spinning.

EXAMPLE 25

A sample of an alloy was prepared by cast and forge ingot metallurgy essentially as described with reference to Example 24. The ingredients of the melt were according to the following formula:

$Ti_{48}Al_{48}Cr_2Si_2$.

The ingredients were formed into a melt and the melt was cast into an ingot.

The ingot had dimensions of about 2 inches in diameter and a thickness of about ½ inch.

The ingot was homogenized by heating at 1250° C. for two hours.

The ingot, generally in the form of a hockey puck, was enclosed laterally in an annular steel band having a wall thickness of about one half inch and having a vertical thickness matching identically that of the hockey puck ingot.

The assembly of the hockey puck ingot and annular retaining ring were heated to a temperature of about 975° C. and were then forged at this temperature. The forging resulted in a reduction of the thickness of the hockey puck ingot and annular retaining ring to half their original thickness.

After the forged ingot was cooled three pins were machined out of the ingot for three different heat treatments. The three different pins were separately annealed for two hours at the three different temperatures listed in Table VI below. Following the individual anneal, the three pins were aged at 1000° C. for two hours.

After the anneal and aging, each pin was machined into a conventional tensile bar and conventional tensile tests were performed on the three resulting bars. The results of the tensile tests are listed in the Table VI.

TABLE VI

| | | Tensile Properties and Oxidation Resistance of Alloys Room Temperature Tensile Test | | | | |
|---|---|---|---|---|---|---|
| Ex. No. | Gamma Alloy No. | Composit. (at. %) | Anneal Temp (°C.) | Yield Strength (ksi) | Fracture Strength (ksi) | Plastic Elongation (%) |
| 2A* | 12A | $Ti_{52}Al_{48}$ | 1300 | 54 | 73 | 2.6 |
| | | | 1325 | 50 | 71 | 2.3 |
| | | | 1350 | 53 | 72 | 1.6 |
| 25 | 156 | $Ti_{52}Al_{44}Cr_2Si_2$ | 1300 | 79 | 98 | 1.7 |

TABLE VI-continued

| Tensile Properties and Oxidation Resistance of Alloys Room Temperature Tensile Test | | | | | | |
|---|---|---|---|---|---|---|
| Ex. No. | Gamma Alloy No. | Composit. (at. %) | Anneal Temp (°C.) | Yield Strength (ksi) | Fracture Strength (ksi) | Plastic Elongation (%) |
| | | | 1325 | 74 | 101 | 2.6 |
| | | | 1350 | 80 | 107 | 2.6 |

* - Example 2A corresponds to Example 2 above in the composition of the alloy used in the example. However, Alloy 12A of Example 2A was prepared by cast and forge ingot metallurgy rather than by the rapid solidification method of Alloy 12 of Example 2. The tensile and elongation properties were tested by the tensile bar method rather than the four point bending testing used for Alloy 12 of Example 2.

As is evident from the table, the three samples of alloy 156 were individually annealed at the three different temperatures and specifically at 1300°, 1325°, and 1350° C. The yield strength of these samples is very substantially improved over the base alloy 12. For example, the sample annealed at 1325° C. had a gain of about 48% in yield strength and a gain of about 42% in fracture strength. This gain in strength was realized with no loss whatever in ductility and in fact with a moderate gain of about 13%.

The substantially improved strength coupled with the moderately improved ductility, when considered together make this a unique gamma titanium aluminide composition and this composition is the subject of commonly owned U.S. Pat. No. 5,045,406.

EXAMPLE 25B

In Example 25 above, the alloy was prepared by casting and forging processing. The alloys of the Examples in this group were prepared by an alternative processing technique and specifically by cast and HIP processing. Specifically, each alloy was separately melted by an electroarc in a copper hearth and was allowed to solidify in the hearth. The ingots obtained were cut into bars, which were separately HIPed (hot isostatic pressed) at 1050° C. for three hours under a pressure of 45 ksi. The bars were then individually subjected to different heat treatment temperatures ranging from 1200° to 1400° C. for two hours. Tensile test specimens were prepared from the heat treated bars and yield strength, fracture strength, and plastic elongation measurements were made. Compositions and properties determined by conventional tensile bar testing for the examples are set forth in Table VII below.

TABLE VII

| Compositions and Properties of Alloys Formed by Cast and HIP Processing | | | | | | |
|---|---|---|---|---|---|---|
| Ex. No. | Alloy No. | Composition (at. %) | Anneal Temp (°C.) | Yield Strength (ksi) | Fracture Strength (ksi) | Plastic Elongation (%) |
| 2B* | 12 | Ti-48Al | 1250 | 54 | 72 | 2.0 |

TABLE VII-continued

| Compositions and Properties of Alloys Formed by Cast and HIP Processing | | | | | | |
|---|---|---|---|---|---|---|
| Ex. No. | Alloy No. | Composition (at. %) | Anneal Temp (°C.) | Yield Strength (ksi) | Fracture Strength (ksi) | Plastic Elongation (%) |
| | | | 1275 | 51 | 66 | 1.5 |
| | | | 1300 | 56 | 68 | 1.3 |
| | | | 1325 | 53 | 72 | 2.1 |
| | | | 1350 | 58 | 70 | 1.0 |
| 25B | 156 | Ti-44Al-2Cr-2Si | 1300 | 83 | 93 | 0.7 |
| | | | 1325 | 92 | 103 | 1.1 |
| | | | 1350 | 97 | 114 | 1.7 |

* - Examples 2B and 25B correspond to Examples 2A and 25 in the composition of the alloys used. However, unlike the previous examples which were processed by casting and forging, these new examples were processed by HIPing the cast ingots without forging.

Table VII contains the data for two sets of alloys prepared by a cast and HIP processing technique. Example 2B is for the alloy 12 which, as indicated from Table I above, is a binary alloy of Ti-48Al. This is the reference alloy referred to in a number of tables above. If the Example 2B of Table VII is compared to Example 2A of Table VI, it is apparent that alloy 12 of Example 2B displays approximately the same yield strength as that of Example 2A of Table VI and also that it displays a reduced ductility.

Example 25B may also be compared with Example 25 of Table VI. It is evident from this comparison that Example 25B displays an increased strength but also displays a reduced ductility.

From a further comparison of the data of Table VII for the Example 2B as contrasted with Example 25B, it is evident that the presence of silicon in the alloy of Example 25B results in an increased strength with a preservation of the ductility of the titanium aluminide alloy.

EXAMPLES 26–29

Four additional samples were prepared by the cast and HIP processing technique. The compositions of these examples as well as the properties measured are set forth in Table VIII immediately below.

TABLE VIII

| Compositions and Properties of Alloys Prepared by Cast and HIP Processing | | | | | | |
|---|---|---|---|---|---|---|
| Ex. No. | Alloy No. | Composition (at. %) | Anneal Temp (°C.) | Yield Strength (ksi) | Fracture Strength (ksi) | Plastic Elongation (%) |
| 26 | 302 | Ti-43Al-2Cr-2Si | 1275 | 84 | 91 | 0.4 |
| | | | 1300 | 79 | 86 | 0.4 |
| | | | 1325 | 78 | 81 | 0.3 |
| 25B | 156 | Ti-44Al-2Cr-2Si | 1300 | 83 | 93 | 0.7 |
| | | | 1325 | 92 | 103 | 1.1 |
| | | | 1350 | 97 | 114 | 1.7 |
| 27 | 303 | Ti-45Al-2Cr-2Si | 1300 | 68 | 78 | 0.7 |
| | | | 1325 | 66 | 82 | 1.3 |

TABLE VIII-continued

Compositions and Properties of Alloys Prepared by Cast and HIP Processing

| Ex. No. | Alloy No. | Composition (at. %) | Anneal Temp (°C.) | Yield Strength (ksi) | Fracture Strength (ksi) | Plastic Elongation (%) |
|---|---|---|---|---|---|---|
| | | | 1350 | 50 | 54 | 0.4 |
| 28 | 236 | Ti-42Al-2Cr-4Si | 1300 | 95 | 115 | 1.1 |
| | | | 1325 | 96 | 112 | 0.7 |
| | | | 1350 | 98 | 107 | 0.5 |
| 29 | 302 | Ti-43Al-2Cr-4Si | 1275 | 70 | 78 | 0.5 |
| | | | 1300 | 72 | 87 | 0.9 |
| | | | 1325 | 66 | 71 | 0.4 |
| | | | 1350 | 71 | 82 | 0.7 |

The alloys for the Examples 26–29 and and 25B of Table VIII were prepared by the cast and HIP processing technique as described above with reference to Example 25B. The data of this example illustrates that the properties of these alloys are very sensitive to the aluminum concentration. Thus, the first three examples of Table VIII had two atom percent chromium and two atom percent silicon in a titanium aluminide where the aluminum concentration varied from 43 atom percent for Example 26, 44 atom percent for Example 25B, and 45 atom percent for Example 27. It is quite clear from comparison of the strength and ductility measured for these three compositions that significant increase in strength as well as increase in ductility occurs as the aluminum concentration goes from 43 atom percent in Example 26 to 44 atom percent in Example 25B.

Also, it is clear that there is a decrease in strength as the aluminum concentration goes from 44 atom percent for Example 25B to 45 atom percent for Example 27. Further, there is some apparent decrease in ductility with this change. This data demonstrates a very sharp sensitivity to aluminum concentration in these alloys.

Further, by comparing the results achieved for the first three compositions which each contain 2 atom percent silicon with the results and data obtained for the last two Examples 28 and 29 containing 4 atom percent silicon, it is evident that the compositions containing 4 atom percent silicon are not superior in an overall sense to those containing 2 atom percent silicon.

Further, it is clear from the data listed for Examples 28 and 29 that the composition for Example 28 is superior to that for Example 29 inasmuch as the alloy for Example 29 had lower strength and also lower ductility than that for Example 28.

From the foregoing, it is apparent that the alloys 156 for Example 25B and 236 for Example 28 are the best alloys of the data presented in Table VIII. Further, the best compositions are those in which the sum of the atomic percentages of the aluminum and silicon ingredients total 46 atom percent. These compositions are the subject of commonly owned U.S. Pat. No. 5,045,406.

EXAMPLES 30–34

Five additional samples were prepared by cast and HIP processing and the strength and ductility properties of these alloys were determined by conventional tensile testing. The results of these tests are included in Table IX immediately below.

TABLE IX

Compositions and Properties of Alloys Prepared by Cast and HIP Processing

| Ex. No. | Alloy No. | Composition (at. %) | Anneal Temp (°C.) | Yield Strength (ksi) | Fracture Strength (ksi) | Plastic Elongation (%) |
|---|---|---|---|---|---|---|
| 30 | 251 | Ti-44Al-2Cr-4Nb-2Si | 1225 | 82 | 89 | 0.4 |
| | | | 1250 | 84 | 87 | 0.2 |
| | | | 1275 | 74 | 88 | 0.7 |
| | | | 1300 | 72 | 82 | 0.5 |
| 31 | 351 | Ti-45Al-2Cr-2Si-4Nb | 1225 | 87 | 100 | 0.8 |
| | | | 1250 | 86 | 106 | 1.6 |
| | | | 1275 | 76 | 92 | 1.0 |
| | | | 1300 | 71 | 89 | 1.1 |
| 32 | 267 | Ti-45Al-2Cr-2Si-4Nb-0.1C | 1250 | 83 | 94 | 0.7 |
| | | | 1275 | 79 | 92 | 1.0 |
| | | | 1300 | 82 | 97 | 1.3 |
| | | | 1325 | 82 | 91 | 0.7 |
| 33 | 288 | Ti-42Al-2Cr-4Si-4Nb | 1275 | 74 | 75 | 0.2 |
| | | | 1300 | 68 | 80 | 0.5 |
| | | | 1325 | 69 | 82 | 0.6 |
| 34 | 239 | Ti-44Al-2Cr-2Si-3Ta | 1250 | 70 | 74 | 0.3 |
| | | | 1300 | — | 75 | 0.2 |
| | | | 1350 | — | 86 | 0.1 |
| | | | 1400 | 72 | 86 | 0.6 |

All of the alloys prepared for these examples 30–34 were prepared by the cast and HIP processing described above with reference to Example 25B. In this set of examples, the base alloy was a titanium aluminide containing chromium and silicon additives. The distinction in this set of examples from the previous set is the addition of a further additive and specifically niobium, or niobium and carbon, or tantalum. The niobium and tantalum additives are known to improve oxidation resistance. The tantalum additive is also known to improve creep resistance. These findings are set forth in commonly owned U.S. Pat. Nos. 4,879,092 and 5,028,491.

However, it will be observed from the data listed in Table IX that the mechanical properties of these alloys are quite sensitive to aluminum concentration as well as to the presence of silicon and tantalum additives.

Of the data presented in Table IX, it is evident that only the alloy of Examples 31 and 32 had good mechanical properties. These properties include a significantly high strength coupled with a moderate level of ductility. The alloy 251 of Example 30 which has 44 atom percent aluminum together with chromium, niobium, and silicon additives have lower values of ductility. The alloy 288 of Example 33 and the alloy 239 of Example 34 have lower aluminum and have the combined chromium, silicon, and niobium additive coupled with 42 atom percent aluminum for alloy 288, and chromium, silicon, and tantalum additive coupled with 44 atom percent aluminum for alloy 239, and each of these alloys has unacceptably low ductility. However, alloy 351 for Example 31 with 45 atom percent aluminum and combined chromium, silicon, and niobium additive has significantly high strength and acceptably moderate ductility. Also, alloy 267 for Example 32 has 45 atom percent of aluminum coupled with chromium, silicon, niobium, and carbon additive and has significant strength coupled with an acceptable level of ductility. The data of Table IX demonstrated that there is a very strong influence of aluminum concentrated on alloy properties but that desirable sets of properties can be achieved at aluminum concentrations between about 42 and 46 atom percent.

It will also be observed from the data set forth in Table IX that the alloy 239 of Example 34 has data values which are generally inferior to those of the alloys of Examples 31, 32, and 33. In particular, the yield strength for alloy 239 annealed at 1300° and 1350° had very low plastic elongation and it was essentially not feasible to obtain yield strength values for the samples. By contrast, the alloys of the Examples 31, 32, and 33 not only gave good plastic elongation data results but had generally higher strength values. As a consequence, it is generally desirable to emphasize the presence of niobium in compositions and to de-emphasize the presence of the tantalum ingredient in compositions where desirable combinations of strength and ductility properties are sought.

What is claimed and sought to be protected by Letters Patent of the United States is as follows:

1. A titanium aluminum alloy consisting essentially of titanium, aluminum, niobium, chromium, and silicon in the following approximate atomic ratio:

$$Ti\text{-}Al_{42\text{-}46}Cr_{1\text{-}3}Si_{1\text{-}4}Nb_{2\text{-}6}.$$

2. A titanium aluminum alloy consisting essentially of titanium, aluminum, niobium, chromium, and silicon in the following approximate atomic ratio:

$$Ti\text{-}Al_{42\text{-}46}Cr_{1\text{-}3}Si_{2}Nb_{2\text{-}6}.$$

3. A titanium aluminum alloy consisting essentially of titanium, aluminum, niobium, chromium, and silicon in the following approximate atomic ratio:

$$Ti\text{-}Al_{42\text{-}46}Cr_{2}Si_{1\text{-}4}Nb_{2\text{-}6}.$$

4. A titanium aluminum alloy consisting essentially of titanium, aluminum, niobium, chromium, and silicon in the following approximate atomic ratio:

$$Ti\text{-}Al_{42\text{-}46}Cr_{2}Si_{2}Nb_{4}.$$

5. The alloy of claim 1, said alloy being prepared by ingot metallurgy.

6. The alloy of claim 2, said alloy being prepared by ingot metallurgy.

7. The alloy of claim 3, said alloy being prepared by ingot metallurgy.

8. The alloy of claim 4, said alloy being prepared by ingot metallurgy.

9. The alloy of claim 5, said alloy having been given a heat treatment between 1250° C. and 1350° C.

10. The alloy of claim 6, said alloy having been given a heat treatment between 1250° C. and 1350° C.

11. The alloy of claim 7, said alloy having been given a heat treatment between 1250° C. and 1350° C.

12. The alloy of claim 8, said alloy having been given a heat treatment between 1250° C. and 1350° C.

13. A structural component for use at high strength and high temperature, said component being formed of a titanium aluminum alloy consisting essentially of titanium, aluminum, niobium, chromium and silicon in the following approximate atomic ratio:

$$Ti\text{-}Al_{42\text{-}46}Cr_{2}Si_{2}Nb_{2\text{-}6}.$$

14. The component of claim 13, wherein the component is a structural component of a jet engine.

* * * * *